US009388655B2

(12) United States Patent
Sommerfeld et al.

(10) Patent No.: US 9,388,655 B2
(45) Date of Patent: Jul. 12, 2016

(54) LOCK RING AND PACKOFF FOR WELLHEAD

(71) Applicant: Cameron International Corporation, Houston, TX (US)

(72) Inventors: Kyle A. Sommerfeld, Houston, TX (US); Hao Bin Huang, Houston, TX (US); Jay P. Painter, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 198 days.

(21) Appl. No.: 14/055,702

(22) Filed: Oct. 16, 2013

(65) Prior Publication Data

US 2015/0101830 A1 Apr. 16, 2015

(51) Int. Cl.
*E21B 33/04* (2006.01)

(52) U.S. Cl.
CPC ..... *E21B 33/04* (2013.01)

(58) Field of Classification Search
CPC ..... E21B 33/00; E21B 33/1291; E21B 33/04; E21B 23/02
See application file for complete search history.

(56) References Cited

U.S. PATENT DOCUMENTS 4,790,572 A 12/1988 Slyker
4,960,172 A 10/1990 Nelson
5,174,376 A 12/1992 Singeetham
6,510,895 B1 1/2003 Koleilat et al.
7,559,366 B2 7/2009 Hunter et al.
2011/0180275 A1* 7/2011 Shaw ..... E21B 33/04 166/387
2013/0008672 A1* 1/2013 Shaw ..... E21B 33/04 166/387
2013/0140042 A1 6/2013 Benson et al.
2014/0069661 A1* 3/2014 Gette ..... E21B 33/04 166/387
2014/0183824 A1* 7/2014 Benson ..... E21B 33/04 277/328

OTHER PUBLICATIONS

Thomas, International Search Report and Written Opinion for PCT/US2014/059711, mailed Jan. 8, 2015.

* cited by examiner

*Primary Examiner* — William P Neuder
(74) *Attorney, Agent, or Firm* — Eubanks PLLC

(57) ABSTRACT

A packoff and a locking assembly installed in a bore of a wellhead component are provided. In one embodiment, a packoff includes inner and outer annular seals and an energizing ring shaped to be wedged between the inner and outer annular seals so as to apply a radially inward biasing force on the inner annular seal and a radially outward biasing force on the outer annular seal. In another embodiment, a locking assembly includes a lock ring that extends into a recess in a wall of the bore of the wellhead component and an actuator radially disposed between an inner component within the bore and the lock ring to retain the lock ring within the recess. The actuator can have an interference fit with the inner component to inhibit movement of the actuator between the lock ring and the inner component. Additional systems, devices, and methods are also disclosed.

20 Claims, 5 Drawing Sheets

LOCK RING AND PACKOFF FOR WELLHEAD

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include wellhead assemblies mounted on wells through which resources are accessed or extracted. Such wellhead assemblies can include a wide variety of components, such as various spools, casings, valves, pumps, fluid conduits, and the like, that control drilling or extraction operations. In many instances, casings are coupled to wellheads via hangers installed in bores of the wellheads. These hangers and other components within the bores can be retained in various ways, and sealing packoffs can be used to seal annular spaces within the bores.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to locking assemblies and sealing packoffs that can be installed within a bore of a wellhead. In one embodiment, a locking assembly includes an actuator that can be driven between a lock ring and another component within the bore to cause the lock ring to expand into a recess in a wall of the bore. In another embodiment, a sealing packoff includes inner and outer annular seals and an energizing ring arranged such that the energizing ring can be wedged between the inner and outer annular seals to apply a radially inward biasing on the inner annular seal and a radially outward biasing force on the outer annular seal. In at least some embodiments, the sealing packoff and the locking assembly can be axially set within the bore without requiring rotation.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
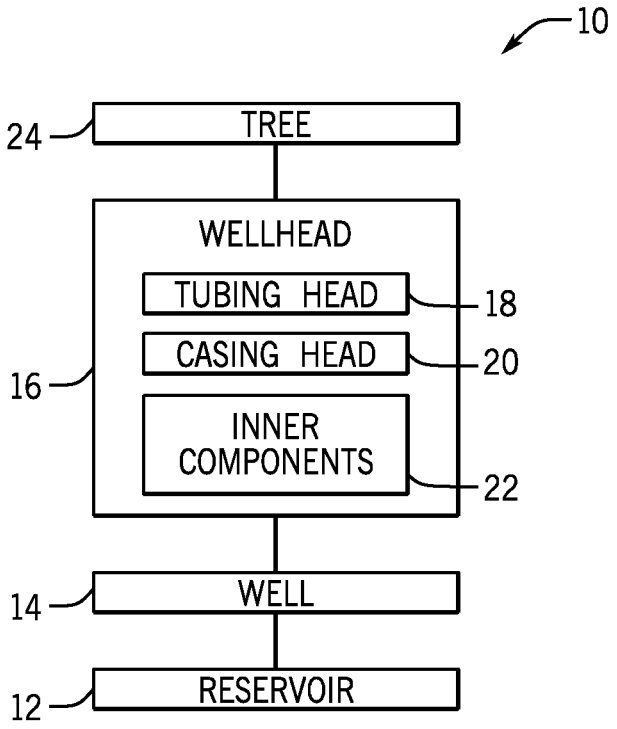
FIG. 1 is a block diagram of a system having a wellhead with various components installed at a well in accordance with one embodiment of the present disclosure.

Turning now to the present figures, a system 10 is illustrated in FIG. 1 by way of example. The system 10 is a production system that facilitates extraction of a resource, such as oil or gas, from a reservoir 12 through a well 14. A wellhead 16 is installed on the well (e.g., attached to the top of casing and tubing strings in the well). As shown here, the wellhead 16 includes at least one tubing head 18 and casing head 20. The wellhead 16 also includes various inner components 22 inside the wellhead, such as annular plugs and casing and tubing hangers. The components 22 inside the wellhead 16 can also include locking assemblies and packoffs, examples of which are described in greater detail below. The depicted system 10 also includes a tree 24 (e.g., a Christmas tree) to facilitate resource production from the well 14.

Figure 2:
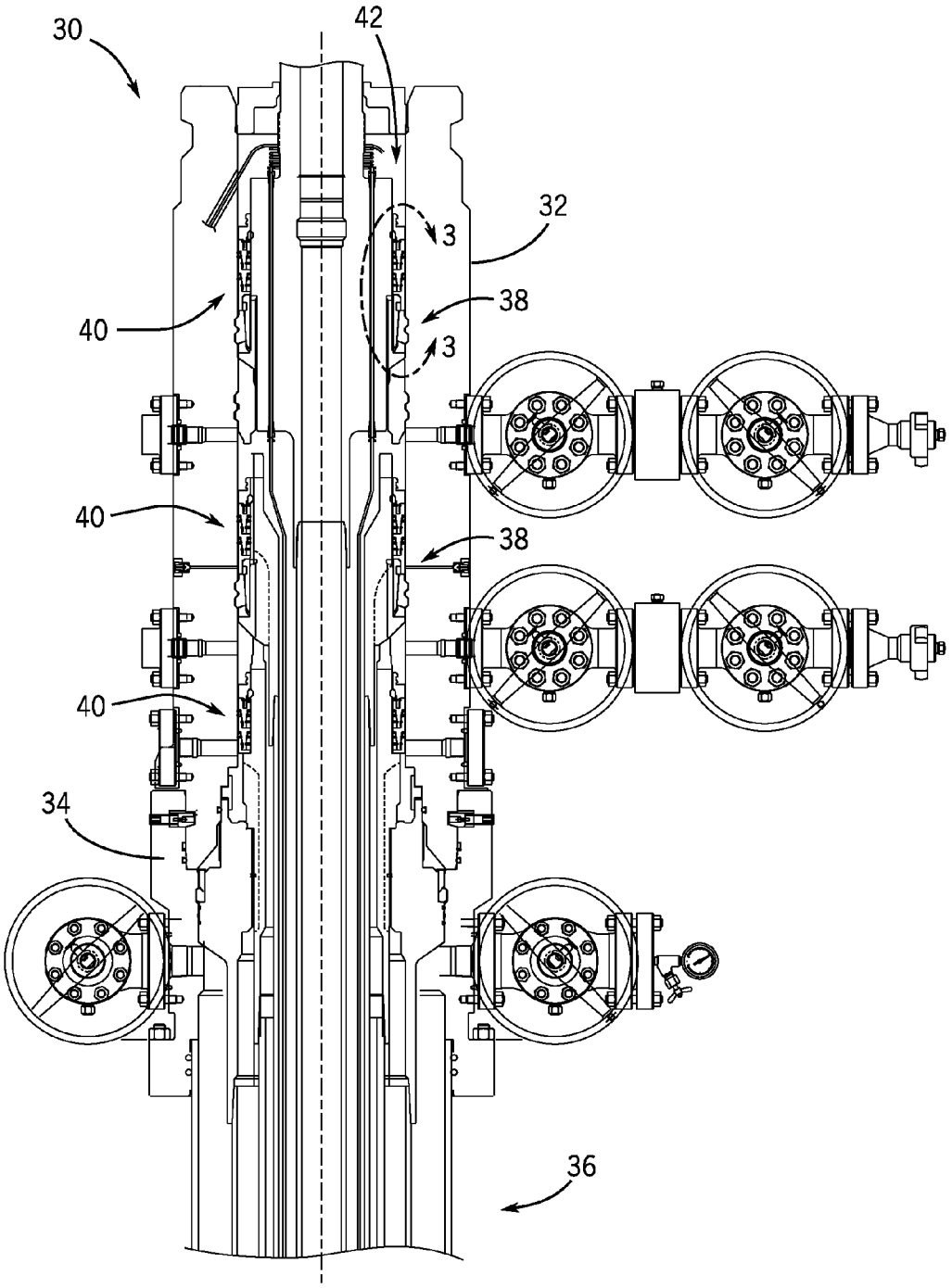
FIG. 2 is a section view of a wellhead having locking assemblies for securing components within a bore of the wellhead and packoffs for sealing annular spaces within the bore in accordance with one embodiment.

An example of a wellhead 30 is generally depicted in FIG. 2 in accordance with one embodiment. This wellhead 30 includes casing heads 32 and 34 connected to a casing system 36. As depicted, the casing system 36 includes five tubular strings (e.g., a production tubing string, intermediate casings, a surface casing, and a conductor pipe) and control lines in the annulus between the two innermost tubular strings, but other embodiments include different casing arrangements. Hangers are connected to the top of various tubular strings (e.g., all of the strings besides the conductor pipe) of the casing system 36 to allow the strings to be suspended from the wellhead 30.

The casing head 32 is illustrated as a multi-bowl casing head that receives hangers for multiple tubular strings, including a production tubing string and intermediate casing strings. This allows a single casing head to support multiple casing strings, rather than using separate heads (e.g., a tubing head 18 and other casing heads 20) for each string. But separate tubing and casing heads could be used for supporting individual strings in other embodiments. Various locking assemblies 38 and packoffs 40 are disposed within the bore 42 of the wellhead 30 to secure the hangers and inhibit fluid leakage. In at least some embodiments, the locking assemblies 38 and the packoffs 40 are constructed for use in high and low temperatures and for high pressure within the wellhead 30 exceeding 20 ksi.

Figure 3:
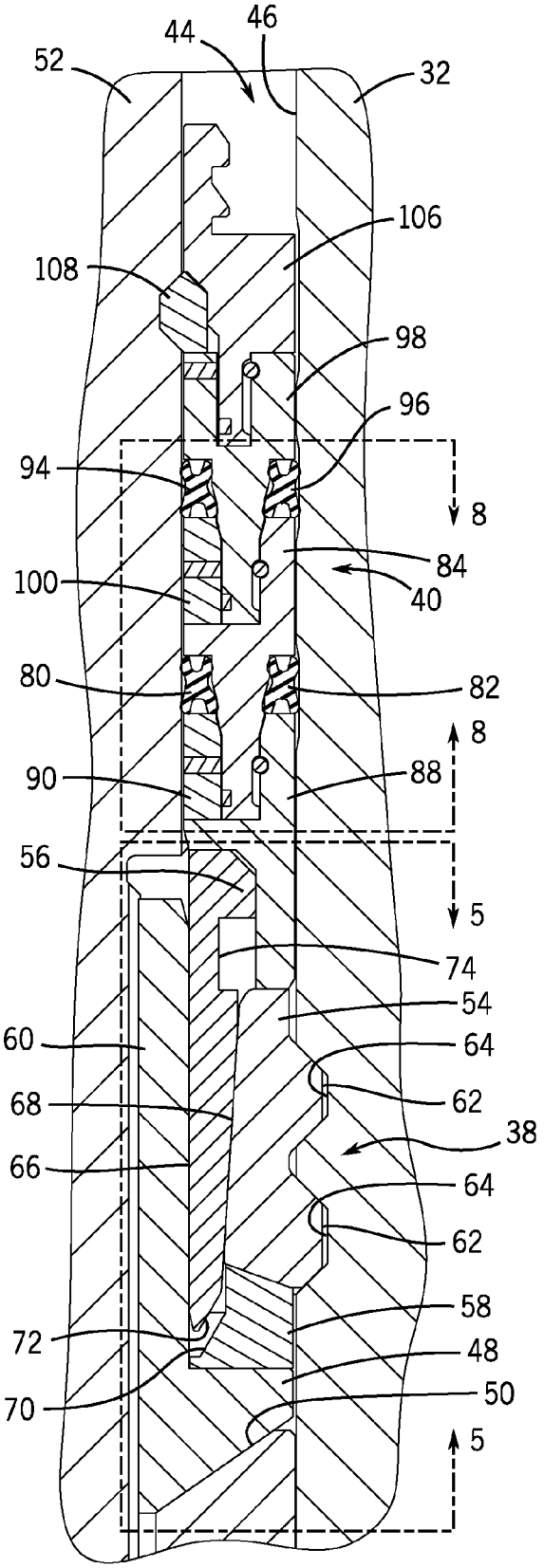
FIG. 3 is a detail view of one locking assembly and one packoff of the wellhead of FIG. 2 in accordance with certain embodiments.

By way of example, a friction locking assembly 38 and a packoff 40 are illustrated in FIG. 3 as installed in an annular space 44 in the bore 42 (between the casing head 32 on the one hand and an inner component in the form of a hanger 48 coupled to an additional inner component 52, such as an annular plug, on the other). As shown in this figure, the hanger 48 is positioned on a landing shoulder 50 within the bore 42. The landing shoulder 50 can be formed integrally with the casing head 32, i.e., as a tapered edge of the bore wall 46, or can be a separate component installed within the bore 42 (as is the case in FIG. 3). The hanger 48 can be threaded onto the component 52 or coupled in some other suitable fashion.

Figure 4:
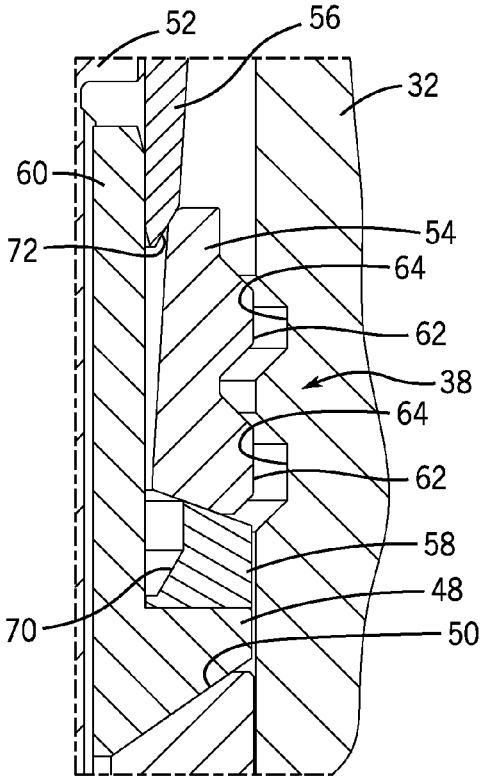
FIGS. 4 and 5 are detail views of the locking assembly depicted in FIG. 3 and generally depict unlocked and locked states of the locking assembly in accordance with one embodiment.
Figure 5:
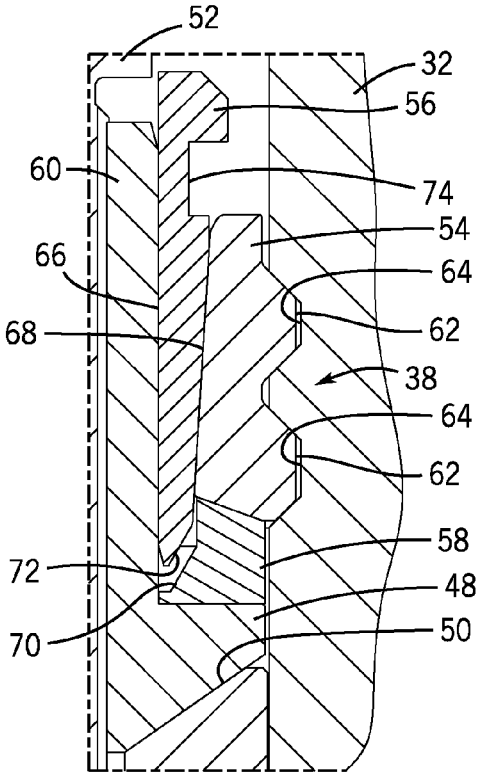

The depicted locking assembly 38, which is shown in greater detail in FIGS. 4 and 5, includes a lock ring 54, an actuator 56, and a load ring 58. The components of the locking assembly 38 can be formed of metal or of any other suitable material. The lock ring 54 is disposed radially about a neck 60 of the hanger 48 and includes ridges 62 along its outer circumference. The bore wall 46 of the casing head 32 has mating recesses 64 for receiving the ridges 62 of the lock ring 54. In the presently depicted embodiment, the load ring 58 also includes a recess 70 for receiving a distal end 72 of the actuator 56.

The locking assembly 38 is shown in its unlocked state in FIG. 4, with the actuator 56 positioned above the lock ring 54, which is withdrawn from the recesses 64. This unlocked state allows the locking assembly 38 to move axially within the bore 42, such as during installation of the locking assembly 38 and the hanger 48 in the casing head 32.

Once the locking assembly 38 and the hanger 48 are axially positioned at their intended locations within the bore 42 (i.e., with the hanger 48 on landing shoulder 50 and the lock ring 54 adjacent the recesses 64), the actuator 56 can be pushed toward the landing shoulder 50 so that the actuator 56 is radially positioned between the lock ring 54 and the neck 60 of the hanger 48. This locked state is depicted in FIG. 5.

A tapered interface 68 of the lock ring 54 and the actuator 56 causes the lock ring 54 to expand radially as the actuator 56 is driven between the lock ring 54 and the neck 60. To facilitate this radial expansion, the lock ring 54 is provided as a split ring (e.g., a C-ring) in at least some embodiments. The expansion of the lock ring 54 results in the movement of the ridges 62 into the recesses 64, which inhibits axial movement of the hanger 48 within the bore 42.

The locking assembly 38 of at least some embodiments can be set using only axial motion to secure the hanger 48 (or some other component) inside the bore 42. Unlike other locking assemblies that require rotation of an element (such as a threaded ring) within bores to set the locking assemblies and secure components within the bores, the presently depicted locking assembly can be set by axially driving (e.g., with a running tool) the actuator 56 between the lock ring 54 and the hanger 48 to cause the lock ring 54 to engage the recesses 64. Rotation of components within a bore can increase the risk of damage to the bore and other components. By axially setting the locking assembly 38, such an increased risk of damage from rotation can be avoided. Axial setting also allows the use of less complicated tooling in installing the locking assembly 38, which can reduce installation time and expense. The locking assembly 38 can also be unlocked via axial force, such as by engaging recess 74 on the actuator 56 and pulling the actuator 56 away from the load ring 58 to allow the lock ring 54 to relax and retract from the recesses 64.

Further, when in its locked position, the locking assembly 38 provides a preload on the hanger 48. This preload in some instances can be equal to the expected loading on the hanger 48 from wellbore fluids in the wellhead 30 during operation. As depicted in FIG. 4, the ridges 62 and recesses 64 have mating tapered edges. As the lock ring 54 is driven into engagement with the recesses 64 by the actuator 56, the mating engagement of the upper tapered surfaces of the ridges 62 and the recesses 64 in FIG. 4 cause the lock ring 54 to be driven downward and to apply a compression force on the load ring 58, thus applying a preload on the hanger 48. It will be appreciated that the amount of preload depends on the geometries of the lock ring 54, the load ring 58, and the recesses 64, which can vary between different embodiments.

In some prior art designs, locking assemblies in wellheads are retained by providing devices, such as springs, above the locking assemblies to load against the locking assemblies and inhibit axial movement. In other prior art designs, threaded connections are used to retain locking assemblies at a desired location. But in contrast to such prior art designs, in at least some embodiments of the present disclosure friction alone is used to retain a locking assembly 38 in the locked position without the need for rotation or other retention mechanisms.

Figure 6:
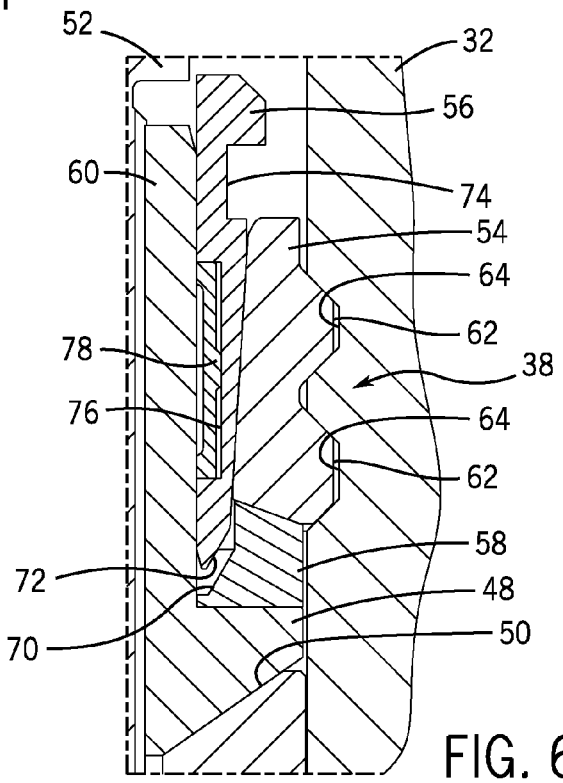
FIG. 6 depicts another locking assembly similar to that of FIG. 3 but including a spring in an actuator of the locking assembly in accordance with one embodiment.

For example, the actuator 56 of the locking assembly 38 depicted in FIG. 5 is installed on the neck 60 of the hanger 48 with an interference fit. Friction caused by the interference fit at the interface 66 between these two components retains the actuator 56 in its locked position. In another embodiment generally depicted in FIG. 6, the actuator 56 has a recess 76 and a spring 78. In its natural, unflexed state the spring 78 is slightly wider than the depth of the recess 76, which causes the spring 78 to bow in the middle when the actuator 56 is moved into its locked position. This, in turn, causes the ends of the spring 78 to press against the neck 60 of the hanger 48, allowing friction between the spring 78 and the hanger 48 to retain the actuator 56 in its locked position.

Returning now to FIG. 3, the packoff 40 is depicted directly above the locking assembly 38. Like the locking assembly 38, the packoff 40 is configured to be run into the bore 42 and set through axial movement without requiring rotation. And while depicted here together, it will be appreciated that each of the locking assembly 38 and the packoff 40 could be used separately without the other.

The packoff 40 includes an inner annular seal 80 and an outer annular seal 82. These annular seals can be formed of metal (enabling metal-to-metal sealing against other metal components) or of any other suitable material. As illustrated, the inner and outer annular seals 80 and 82 have cross-sectional profiles that include arms that extend outwardly from a central portion to seal against other components. But the annular seals 80 and 82 can be provided with different shapes in other embodiments.

The packoff 40 also includes an energizing ring 84. As discussed in greater detail below, the energizing ring 84 is shaped to be wedged between the inner annular seal 80 and the outer annular seal 82 to deflect and energize these seals by applying radially inward and outward biasing forces, respectively, to the seals. In FIG. 3, the outer annular seal 82 is depicted as resting on a landing ring 88 that is positioned in contact with the actuator 56 of the locking assembly 38. The inner annular seal 80 is shown as resting on a retaining ring 90. Although provided in FIG. 3 as a separate component, the retaining ring 90 could instead be integrated as part of the landing ring 88.

In one embodiment, the packoff 40 could include only one pair of annular seals (e.g., inner and outer annular seals 80 and 82). But multiple pairs of annular seals (each pair having a respective energizing ring) can be used in series in the packoff 40 to provide multiple pressure barriers. For instance, the packoff 40 in FIG. 3 includes an additional pair of annular seals, namely inner annular seal 94 and outer annular seal 96. The inner and outer annular seals 94 and 96 are identical to the seals 80 and 82 in the present embodiment, but could vary in others. The packoff 40 includes an additional energizing ring 98 that is shaped to be wedged between the inner and outer annular seals 94 and 96 to apply a radially inward biasing force on the seal 94 and a radially outward biasing force on the seal 96. The outer annular seal 96 is depicted as resting on the energizing ring 84 and the inner annular seal 94 is depicted as resting on a retaining ring 100, which could instead be provided as an integral portion of the energizing ring 84.

While the packoff 40 is depicted here as having only two sets of inner and outer annular seals with associated energizing rings, further sets of seals and energizing rings could be connected in series with those described above. Each pair of inner and outer annular seals (e.g., seals 80 and 82; seals 94 and 96) can be provided as concentric ring seals that are axially aligned with one another (i.e., both intersecting a shared axial plane through the wellhead 30), as generally depicted in the present figures. But in other embodiments the seals could be provided in different arrangements, such as being axially offset from one another. The packoff 40 of FIG. 3 also includes an actuator 106 and an associated lock ring 108 above the uppermost energizing ring (here ring 98) for retaining the packoff 40 in its installed position.

Figure 7:
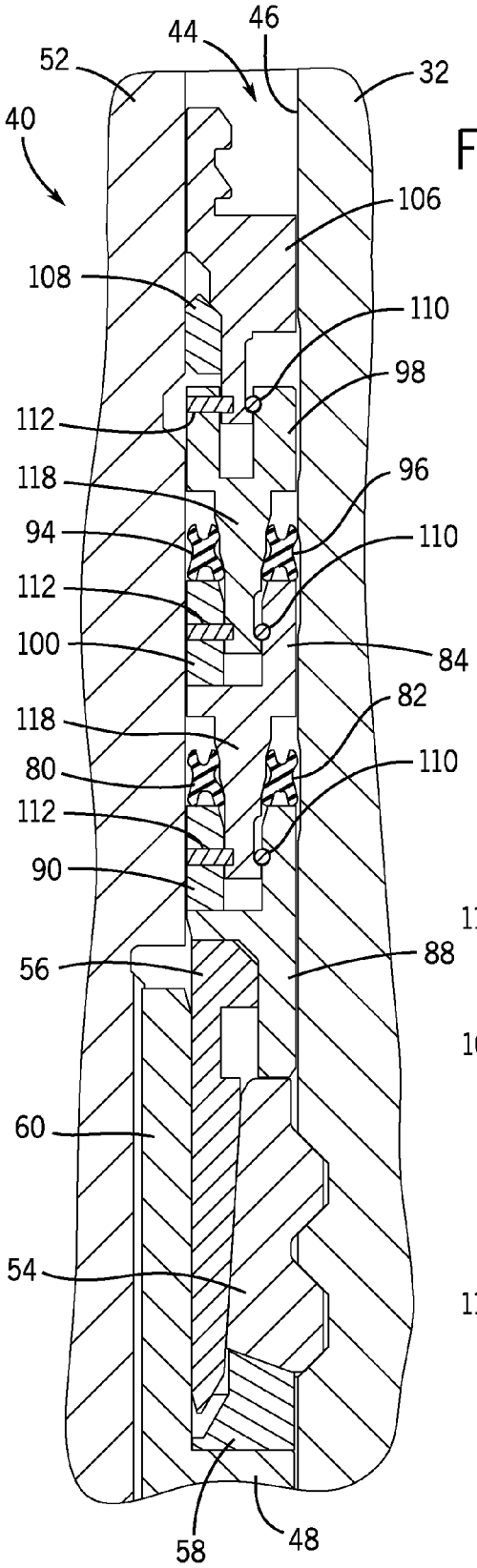
FIG. 7 depicts the packoff of FIG. 3 in a relaxed state as it is being positioned within the bore of the wellhead and before it is set in accordance with one embodiment.
Figure 8:
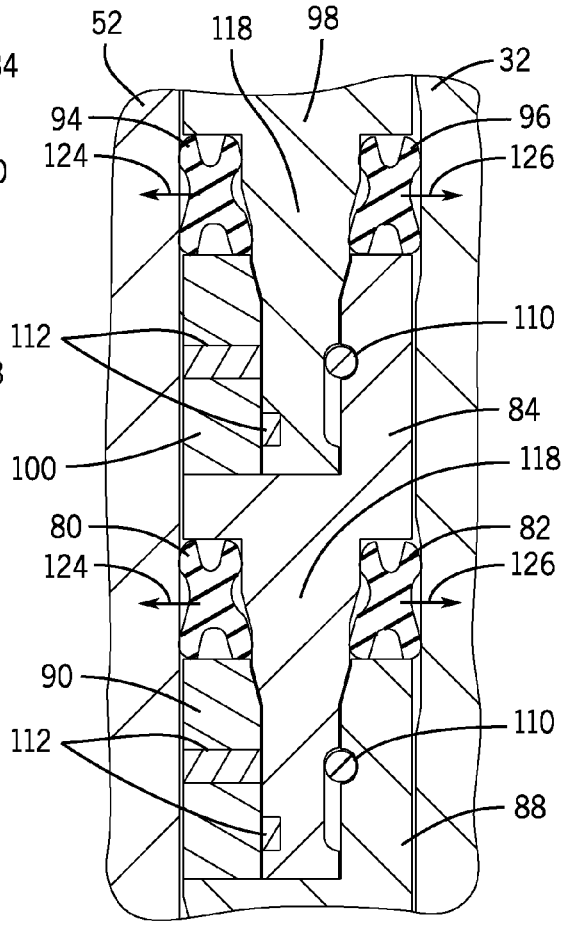
FIG. 8 is a detail view of a portion of the packoff of FIG. 3 and depicts the setting of annular seals of the packoff with energizing rings in accordance with one embodiment.

Installation and setting of the packoff 40 may be better understood with reference to FIGS. 7 and 8. Before being installed in the wellhead 30, the packoff 40 is in a relaxed state in which its inner and outer annular seals are withdrawn into the radial profile of the packoff 40 to reduce or eliminate contact by these seals against the wall 46 or the inner component 52 as the packoff 40 is run into the annular space 44 of the bore 42. In FIG. 7, the packoff 40 is depicted as having been run into the bore 42 until the landing ring 88 contacts the actuator 56 of the locking assembly 38. But the packoff 40 is shown here as still being in its relaxed state (the same state the packoff 40 is in before it is inserted into the bore 42) prior to energizing the inner and outer seals with the energizing rings.

In this relaxed state, the energizing ring 84 is spaced axially apart from the landing ring 88, the energizing ring 98 is spaced axially apart from the ring 84, and the actuator 106 is spaced axially apart from the ring 98. The packoff 40 can be held together with retaining wires 110 and shear pins 112 while in its relaxed state to facilitate handling and to enable the packoff 40 to be run into the bore 42 as a single unit (e.g., in a single operation by a running tool coupled to the actuator 106). One or more shear rings can be used with or instead of the shear pins 112 in other embodiments. The packoff 40 can first be axially run into the bore 42 to the position depicted in FIG. 7. Further axial force can then be applied to the packoff 40 (e.g., to the actuator 106) to break the shear pins 112 and cause tapered portions 118 of the energizing rings 84 and 98 to be driven downward and wedged between the inner and outer annular seals. This, in turn, causes the tapered portions 118 to energize the seals by driving the inner annular seals 80 and 94 radially inward against the inner component 52, as represented by arrows 124 in FIG. 8, and driving the outer annular seals 82 and 96 radially outward against the wall 46 (which may include recesses for receiving the seals, like in FIG. 8), as represented by arrows 126. Sealing contact is made by the inwardly extending pairs of arms of inner annular seals 80 and 94 and by the outwardly extending pairs of arms of outer annular seals 82 and 96.

In one embodiment, the shear pins 112 are designed to shear in a staggered fashion. For instance, to avoid energizing the annular seals 94 and 96 before they are positioned at their desired axial location in the bore 42, the shear pin 112 through the retaining ring 90 can be configured to break first to allow energizing ring 84 to energize the seals 80 and 82. As the energizing ring 84 is driven axially downward between the seals 80 and 82, the seals 94 and 96 move into their desired axial position. The shear pin 112 through the retaining ring 100 can be configured to break next, allowing the energizing ring 98 to be driven axially downward to then energize the seals 94 and 96. The shear pin 112 holding the energizing ring 98 to the actuator 106 can then be broken to drive the lock ring 108 toward a recess in the inner component 52. Other techniques for timing the energizing of the seals and the movement of the various components of the packoff 40 (e.g., using shear rings) may also be used in full accordance with the present techniques.

The packoff 40 can be removed from the bore 42 by pulling the actuator 106 to release the lock ring 108. As the actuator 106 moves up the bore 42, the retaining wires 110 cause the energizing rings 84 and 98 to be pulled from the seals, allowing the seals to relax and the packoff 40 to be removed from the bore 42. And as noted above with respect to the locking assembly 38, the ability to axially set and remove the packoff 40 without requiring rotation can reduce the risk of damage to components of the wellhead and allow simpler tooling to be used.

In addition to simplifying installation by being axially set within a bore, the disclosed locking assemblies 38 and packoffs 40 can also enable the use of a shorter wellhead assembly. For example, by omitting separate retention devices above the locking assemblies 38, packoffs 40 can be installed closer to (e.g., in contact with) the locking assemblies 38. The seals of the packoffs 40 can also be axially set with a lower setting load and have lower preload requirements compared to wedge seals used in some other arrangements. This allows the packoffs 40 to omit both the longer, rotatable actuators (and threads) and the crushable spacers between seals of a previous arrangement, providing further space savings. In one comparison, the axial length of a combination of one locking assembly 38 and one packoff 40 (as depicted in FIG. 3) was determined to be thirty-five percent less than a locking assembly—packoff combination of a previous design. And a wellhead can include multiple locking assemblies and packoffs (see, e.g., FIG. 2), allowing the aggregate reduction in axial length to be even more substantial.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a wellhead component having a bore;

an inner component disposed within the bore of the wellhead component;

a locking assembly disposed within the bore between the inner component and the wellhead component to secure the inner component within the bore of the wellhead component, the locking assembly including:

a lock ring that extends into a recess in a wall of the bore of the wellhead component; and an actuator radially disposed between the inner component and the lock ring to retain the lock ring within the recess;

wherein the actuator has an interference fit with the inner component to inhibit movement of the actuator between the lock ring and the inner component; and a packoff disposed in the bore of the wellhead component, the packoff including:

an inner annular seal;

an outer annular seal; and an energizing ring shaped to be wedged between the inner annular seal and the outer annular seal so as to apply a radially inward biasing force on the inner annular seal and a radially outward biasing force on the outer annular seal.

2. The system of claim 1, wherein the packoff includes an additional inner annular seal, an additional outer annular seal, and an additional energizing ring shaped to be wedged between the additional inner annular seal and the additional outer annular seal so as to apply a radially inward biasing force on the additional inner annular seal and a radially outward biasing force on the additional outer annular seal.

3. The system of claim 1, wherein the inner annular seal has a pair of arms that extend radially inward and the outer annular seal has a pair of arms that extend radially outward to facilitate sealing of an annular space by the packoff.

4. The system of claim 1, wherein the inner annular seal is concentric with the outer annular seal.

5. The system of claim 4, wherein the inner annular seal is axially aligned with the outer annular seal.

6. The system of claim 1, wherein the packoff includes a landing ring.

7. The system of claim 6, wherein the landing ring is positioned within the bore on the actuator of the locking assembly.

8. The system of claim 6, wherein the packoff includes a retaining ring between the landing ring and the inner annular seal.

9. The system of claim 1, wherein the energizing ring is wedged between the inner annular seal and the outer annular seal.

10. The system of claim 1, wherein the energizing ring includes a tapered portion that facilitates wedging of the energizing ring between the inner annular seal and the outer annular seal.

11. The system of claim 1, wherein the inner component is a hanger.

12. The system of claim 1, wherein the locking assembly includes a load ring between the lock ring and a shoulder of the inner component.

13. The system of claim 1, wherein the lock ring cooperates with the recess in the wall of the bore to preload the inner component.

14. The system of claim 1, wherein both the locking assembly and the packoff are configured to be axially set in the bore without rotation.

15. A packoff for a bore of a wellhead component, the packoff including:

an inner annular seal;

an outer annular seal;

an energizing ring shaped to be wedged between the inner annular seal and the outer annular seal so as to apply a radially inward biasing force on the inner annular seal and a radially outward biasing force on the outer annular seal;

an additional inner annular seal;

an additional outer annular seal;

an additional energizing ring shaped to be wedged between the additional inner annular seal and the additional outer annular seal so as to apply a radially inward biasing force on the additional inner annular seal and a radially outward biasing force on the additional outer annular seal;

a first shear component for holding the energizing ring in a relaxed state during running of the packoff into a bore of a wellhead component; and a second shear component for holding the additional energizing ring in a relaxed state during running of the packoff into the bore of the wellhead component, wherein the first shear component is configured to shear before the second shear component upon application of a setting force on the packoff once run into the bore so as to facilitate setting of the inner annular seal and of the outer annular seal via the energizing ring before setting of the additional inner annular seal and of the additional outer annular seal via the additional energizing ring.

16. The packoff of claim 15, wherein the first and second shear components include shear pins.

17. The packoff of claim 15, wherein the energizing ring includes a tapered portion that facilitates wedging of the energizing ring between the inner annular seal and the outer annular seal.

18. A method comprising:

inserting a packoff into a bore of a wellhead component, the packoff including an inner annular seal, an outer annular seal, and an energizing ring shaped to be wedged between the inner annular seal and the outer annular seal so as to apply a radially inward biasing force on the inner annular seal and a radially outward biasing force on the outer annular seal, the packoff also including an additional inner annular seal, an additional outer annular seal, and an additional energizing ring shaped to be wedged between the additional inner annular seal and the additional outer annular seal so as to apply a radially inward biasing force on the additional inner annular seal and a radially outward biasing force on the additional outer annular seal, wherein the packoff is inserted into the bore such that additional inner annular seal and the additional outer annular seal are positioned higher in the bore than the inner annular seal and the outer annular seal;

positioning the packoff between the wellhead component and an inner component also present within the bore of the wellhead component; and applying an axial force to the packoff to first set the inner and outer annular seals and to then set the additional inner and outer annular seals after setting the inner and outer annular seals, wherein applying the axial force to the packoff includes applying the axial force so as to wedge the energizing ring between the inner annular seal and the outer annular seal such that the radially inward biasing force applied by the energizing ring facilitates sealing of the inner annular seal against the inner component and the radially outward biasing force applied by the energizing ring facilitates sealing of the outer annular seal against a wall of the bore of the wellhead component, and to then wedge the additional energizing ring between the additional inner annular seal and the additional outer annular seal such that the radially inward biasing force applied by the additional energizing ring facilitates sealing of the additional inner annular seal against the inner component and the radially outward biasing force applied by the additional energizing ring facilitates sealing of the additional outer annular seal against the wall of the bore of the wellhead component.

19. The method of claim 18, wherein inserting the packoff into the bore of the wellhead component includes inserting the energizing ring, the inner annular seal, the outer annular seal, the additional energizing ring, the additional inner annular seal, the additional outer annular seal, and a landing ring of the packoff together as a single unit.

20. The method of claim 19, comprising assembling the packoff such that the inner and outer annular seals are withdrawn inside recessed portions of the energizing ring prior to inserting the packoff into the bore of the wellhead component.

* * * * *